US008056376B2

(12) United States Patent
Yu

(10) Patent No.: US 8,056,376 B2
(45) **Date of Patent: *Nov. 15, 2011**

(54) DUAL-LOCK TYPE PADLOCK HAVING DOUBLE REMINDING FUNCTION

(76) Inventor: Chun Te Yu, Fusing Township, Changhua County (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/588,600

(22) Filed: Oct. 21, 2009

(65) Prior Publication Data

US 2010/0037663 A1 Feb. 18, 2010

Related U.S. Application Data

(63) Continuation of application No. 11/272,709, filed on Nov. 15, 2005, now Pat. No. 7,628,045.

(30) Foreign Application Priority Data

Nov. 23, 2004 (TW) ..... 93218813 U
Apr. 29, 2005 (TW) ..... 94114058 A

(51) Int. Cl.
*E05B 37/02* (2006.01)

(52) U.S. Cl. ..... 70/21; 70/25; 70/38 B; 70/284; 70/285; 70/432

(58) Field of Classification Search ..... 70/432–441, 70/21, 25, 26, 284, 285, DIG. 59, DIG. 63, 70/38 R, 38 A, 38 B
See application file for complete search history.

(56) References Cited

U.S. PATENT DOCUMENTS

| | | | | |
|---|---|---|---|---|
| 1,597,560 | A | 8/1926 | Wise | |
| 4,751,830 | A | 6/1988 | Cheng | |
| 6,539,761 | B2 | 4/2003 | Yang | |
| 6,877,345 | B1 | 4/2005 | Misner et al. | |
| 7,007,521 | B1 * | 3/2006 | Misner et al. | 70/21 |
| 7,047,773 | B1 * | 5/2006 | Lin | 70/25 |
| 7,100,401 | B2 * | 9/2006 | Yu | 70/21 |
| 7,131,299 | B1 * | 11/2006 | Huang | 70/21 |
| 7,155,943 | B1 * | 1/2007 | Lin | 70/21 |
| 7,155,944 | B1 * | 1/2007 | Lin | 70/21 |
| 7,159,422 | B1 * | 1/2007 | Misner et al. | 70/21 |
| 7,201,026 | B2 * | 4/2007 | Yu | 70/21 |
| 7,204,108 | B2 * | 4/2007 | Yu | 70/21 |
| 7,628,045 | B2 * | 12/2009 | Yu | 70/21 |
| 2002/0088256 | A1 | 7/2002 | Taylor et al. | |
| 2004/0226324 | A1 | 11/2004 | Loughlin et al. | |
| 2005/0262902 | A1 * | 12/2005 | Ling et al. | 70/21 |
| 2005/0262903 | A1 * | 12/2005 | Ling et al. | 70/21 |
| 2006/0032274 | A1 * | 2/2006 | Yu | 70/25 |
| 2006/0107709 | A1 * | 5/2006 | Yu | 70/21 |
| 2006/0107710 | A1 * | 5/2006 | Yu | 70/25 |
| 2006/0236731 | A1 * | 10/2006 | Yu | 70/21 |
| 2006/0254325 | A1 * | 11/2006 | Yu | 70/21 |
| 2006/0254329 | A1 * | 11/2006 | Yu | 70/284 |
| 2006/0266084 | A1 * | 11/2006 | Kuo et al. | 70/21 |

* cited by examiner

*Primary Examiner* — LLoyd Gall
(74) *Attorney, Agent, or Firm* — Rosenberg, Klein & Lee

(57) ABSTRACT

A lock includes a housing, a locking mechanism and an indicator. The locking mechanism is disposed in the housing and includes a first module and a second module both configured to lock or unlock the lock. The indicator is able to move from an original position to an indicative position outside the housing in response to operation of the first module. However, when being located in the indicative position, the indicator is unresponsive to the operation of the first module.

6 Claims, 13 Drawing Sheets

DUAL-LOCK TYPE PADLOCK HAVING DOUBLE REMINDING FUNCTION

CROSS REFERENCE TO RELATED APPLICATION

This is a continuation of U.S. patent application Ser. No. 11/272,709, now U.S. Pat. No. 7,628,045, filed on Nov. 15, 2005, which is based upon and claims the priority benefit of Taiwan Application Serial No. 093218813, filed on Nov. 23, 2004, which is incorporated herein by reference.

BACKGROUND OF THE INVENTION

1. Field of the Invention

The present invention relates to a dual-lock type padlock, and more particularly to a dual-lock type padlock having a double reminding function.

2. Description of the Related Art

A conventional padlock in accordance with the prior art was disclosed in the U.S. Pat. No. 6,877,345 and comprises a housing, a shackle, a number lock module, a key lock module, and an indicator. The shackle is movably mounted on the housing. The housing has a window for exposing the indicator which presents a first color in the window. When the key lock module is unlocked, the indicator presents a second color in the window so as to remind the user that the key lock module has been unlocked. When the number lock module is unlocked, the indicator is reset to present the first color in the window. However, the indicator occupies the inner space of the housing, and the window of the housing is too small. In addition, the user has to see the second color in the window so as to understand if the key lock module has been unlocked, so that such a padlock is not available for the blind people, thereby limiting the versatility of the padlock.

Another conventional padlock in accordance with the prior art was disclosed in the U.S. Patent Publication No. 2002/0088256A1 and comprises a shackle 14, a shackle sleeve 96, and a housing to lock an article. However, such a padlock only includes a number lock module without providing a key lock module. In addition, such a padlock is not provided with an indicator.

The closest prior art references of which the applicant is aware are disclosed in U.S. Pat. Nos. 1,597,560, 4,751,830 and 6,539,761, each comprising a housing and a shackle to lock an article.

SUMMARY OF THE INVENTION

The present invention is to mitigate and/or obviate the disadvantage of the conventional padlocks.

The primary objective of the present invention is to provide a dual-lock type padlock having a double reminding function.

Another objective of the present invention is to provide a dual-lock type padlock, wherein the padlock is provided with a limit knob whose movement is controlled by a locking mechanism, so that when the limit knob is moved to an opened position, the shackle is rotated to be detached from the limit knob.

A further objective of the present invention is to provide a dual-lock type padlock, wherein the indicator is movably mounted on an outer face of the housing or the catch member which is formed with a first mark and a second mark in the corresponding positions, so that the user can judge if the padlock has been unlocked by inspecting the position of the first mark or the second mark, and can also feel the position of the indicator by touching the indicator so as to judge if the padlock has been unlocked, thereby facilitating the blind people operating the padlock.

In accordance with one embodiment of the present invention, there is provided a dual-lock type lock, comprising:

a lock body that is opened by either one of a key and a code;

an indicator movably mounted on the lock body, wherein:

when the lock body is opened by the key, the indicator is changed from a first position to a second position;

the indicator is returned from the second position to the first position only when the lock body is opened by the code;

the lock body has an outer face formed with a first mark and a second mark;

when the indicator is disposed in the first position, the first mark is exposed outward and the second mark is covered by the indicator;

when the indicator is disposed in the second position, the second mark is exposed outward and the first mark is covered by the indicator.

In accordance with another embodiment of the present invention, there is provided a dual-lock type lock, comprising:

a housing;

a catch member including a limit knob and a base portion extended from the limit knob to form a movable connection with the housing, the base portion of the catch member has an exposed section located between the limit knob and the housing;

a shackle including a root section to form a movable connection with the housing, and a free section having a first end extended from the root section and a second end extended into the limit knob;

a locking mechanism mounted in the housing and including:

a number lock module connected with the root section of the shackle and arranged to allow rotation of the root section of the shackle, wherein when the number lock module is disposed at an unlocked state, the number lock module allows the shackle to move with displacement of the root section; and a key lock module connected with the base portion of the catch member and driven by a specified key which is rotated to drive the base portion of the catch member so as to control movement of the catch member; and an indicator movably mounted on an outer face of the exposed section, wherein when the free section of the shackle is rotatable, the indicator is changed from a first position to a second position, and the indicator is returned from the second position to the first position only when the number lock module is disposed at the unlocked state.

Further benefits and advantages of the present invention will become apparent after a careful reading of the detailed description with appropriate reference to the accompanying drawings.

DETAILED DESCRIPTION OF THE INVENTION

Figure 1:
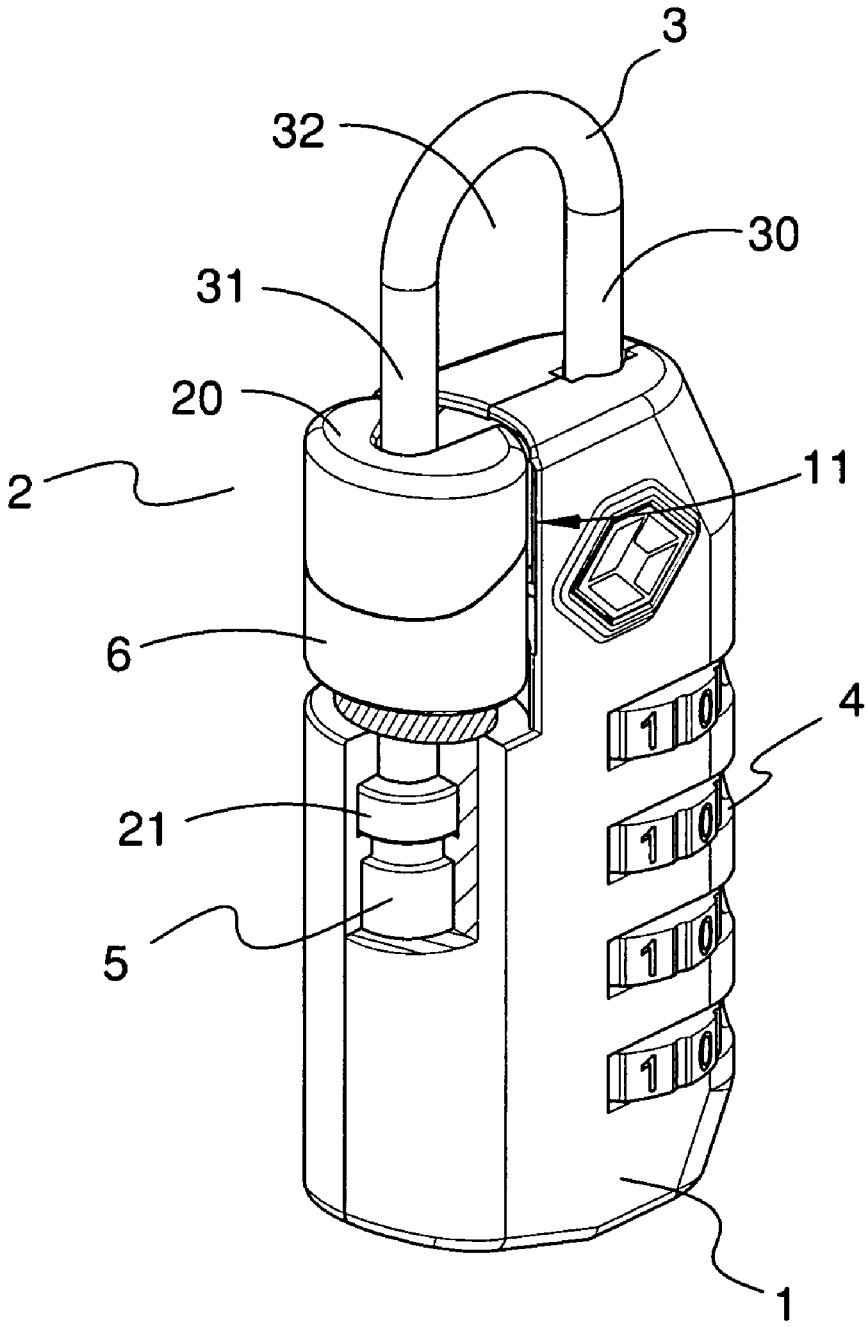
FIG. 1 is a perspective view of a dual-lock type padlock in accordance with the first preferred embodiment of the present invention.

Referring to the drawings and initially to FIG. 1, a dual-lock type padlock having a double reminding function in accordance with the first preferred embodiment of the present invention comprises a housing 1, a catch member 2, a shackle 3, a locking mechanism, and an indicator 6.

The catch member 2 includes a limit knob 20 and a base portion 21 extended from the bottom face of the limit knob 20 into the housing 1 to form a movable connection with the housing 1.

The shackle 3 includes a root section 30 extended into the housing 1 to form a movable connection with the housing 1, and a free section 31 having a first end extended from the root section 30 and a second end extended into the limit knob 20, thereby forming a closed zone 32 therebetween.

The locking mechanism is mounted in the housing 1 and includes a number lock module 4 and a key lock module 5.

The number lock module 4 is connected with the root section 30 of the shackle 3 and arranged to allow rotation of the root section 30 of the shackle 3. In addition, when the number lock module 4 is disposed at the unlocked state (the code is correct), the number lock module 4 allows the shackle 3 to move with displacement of the root section 30.

The key lock module 5 is connected with the base portion 21 of the catch member 2 and driven by a specified key which is rotated to drive the base portion 21 of the catch member 2 so as to control movement of the catch member 2.

Figure 2:
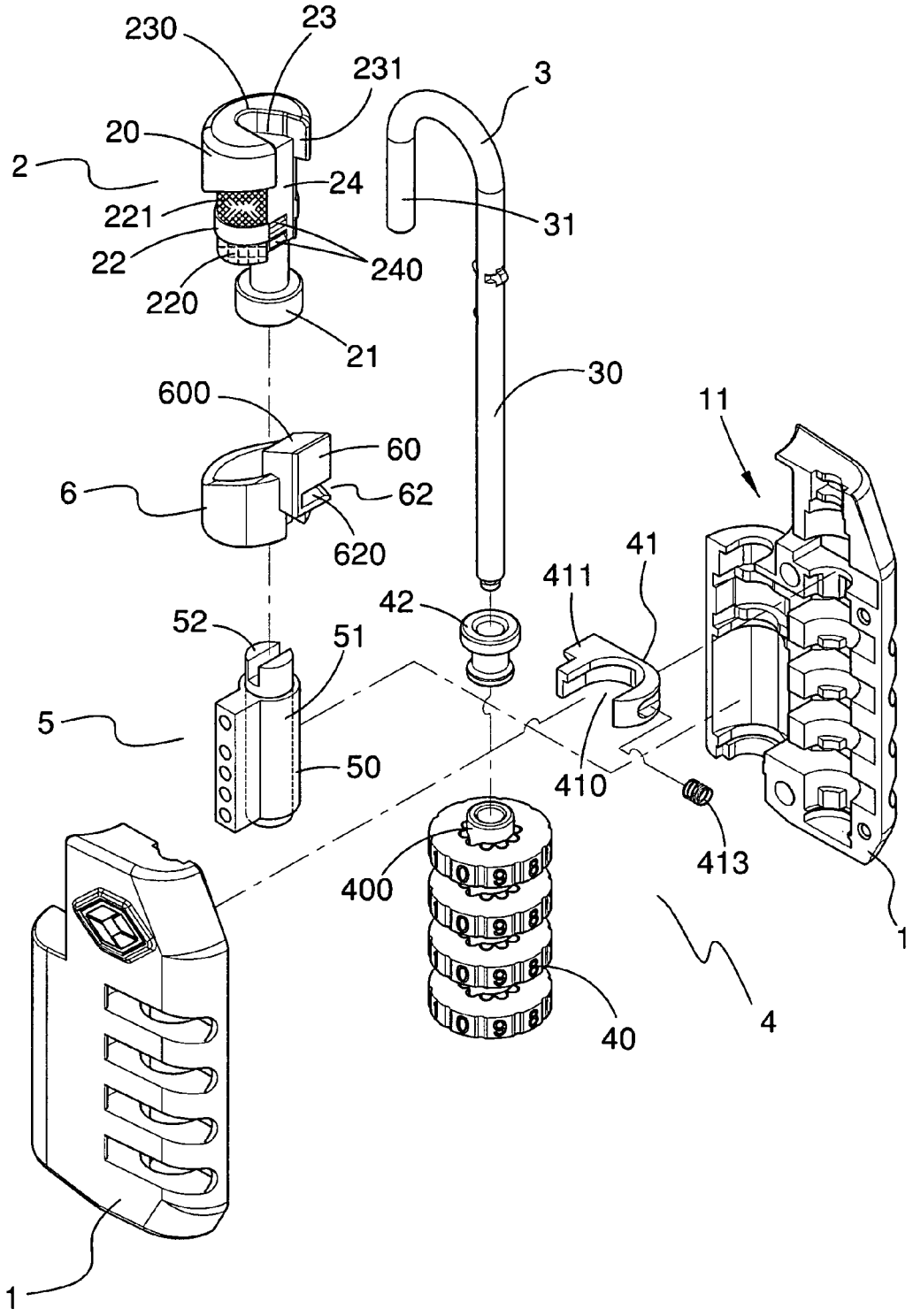
FIG. 2 is an exploded perspective view of the dual-lock type padlock as shown in FIG. 1.

Referring to FIG. 2, the limit knob 20 of the catch member 2 has a receiving recess 23 having a first opening 230 located at the top face of the limit knob 20 and a second opening 231 located at the side face of the limit knob 20. The base portion 21 of the catch member 2 has an exposed section 22 located between the limit knob 20 and the housing 1. The indicator 6 is movably mounted on an outer face of the exposed section 22. When the free section 31 of the shackle 3 is rotated to be detached from the limit knob 20, the indicator 6 is changed from a first position (or original position) to a second position (or indicative position). In addition, the indicator 6 is returned from the second position to the first position only when the number lock module 4 is disposed at the unlocked state. The housing 1 has a recessed space 11 to receive the limit knob 20 and the indicator 6. The space 11 has a height at least equal to that of the limit knob 20 so that the second opening 231 of the limit knob 20 will not expose from the housing 1 to prevent a person from driving the limit knob 20 through the second opening 231 of the limit knob 20.

Figure 3A:
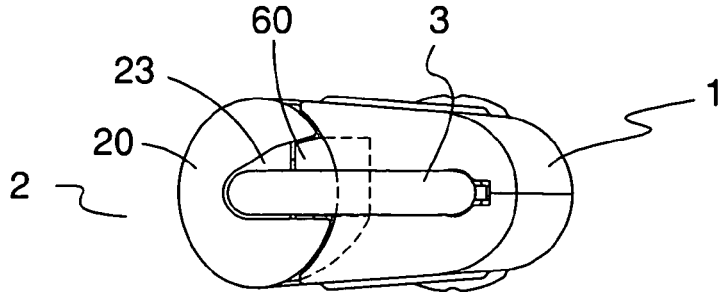
FIG. 3A is a top plan view of the dual-lock type padlock as shown in FIG. 3.
Figure 3:
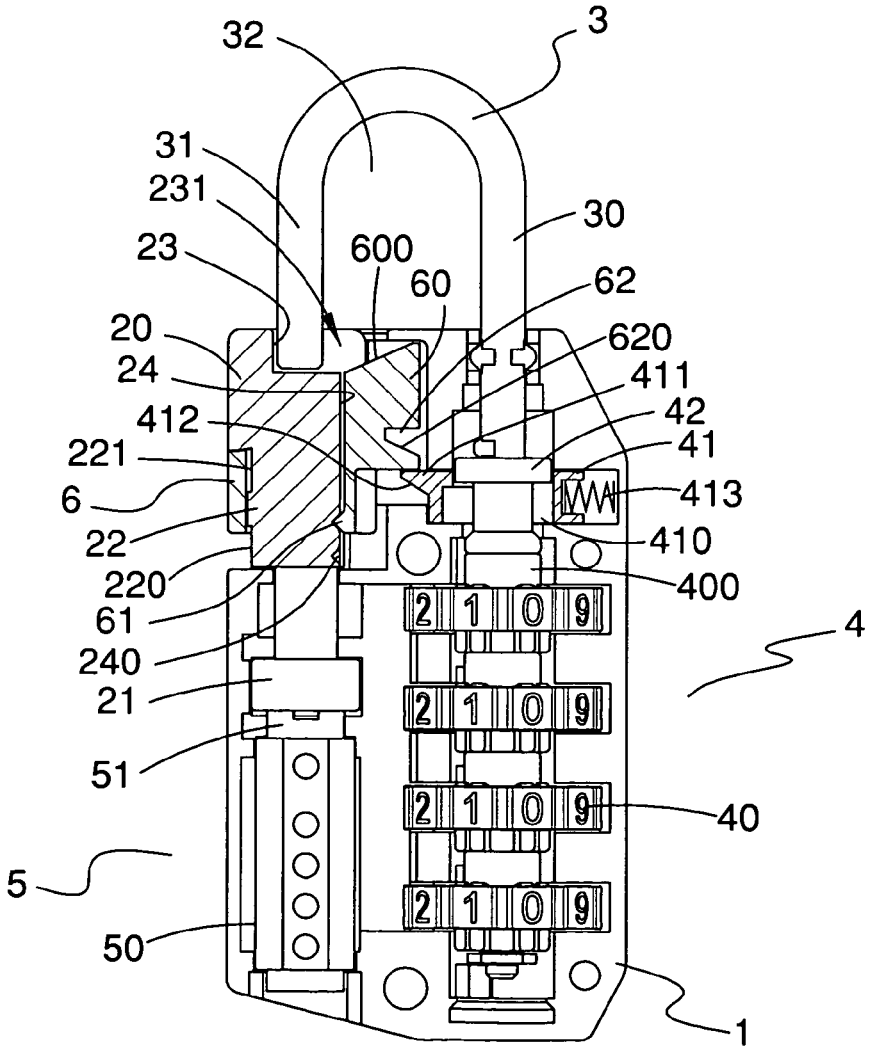
FIG. 3 is a plan cross-sectional view of the dual-lock type padlock as shown in FIG. 1.

Referring to FIGS. 2, 3 and 3A, the exposed section 22 has a surface formed with a first mark 220 and a second mark 221 and has a side formed with a slideway 24 extended into the second opening 231 of the limit knob 20 and having two positioning grooves 240. The indicator 6 has a side formed with a slide 60 and an elastic hook 61. The slide 60 is slidable in the slideway 24 and has a top formed with a tapered face 600 inclined toward the second opening 231 of the limit knob 20 to be pushed by the end portion of the free section 31 of the shackle 3. The elastic hook 61 is hooked in one of the two positioning grooves 240.

As shown in FIGS. 2 and 3, the slide 60 has a locking groove 62 having a bottom face formed with a tapered guide face 620 inclined downward.

The number lock module 4 includes a number wheel unit 40, a locking member 41, and a limit member 42. The number wheel unit 40 has a retractable shaft 400. The locking member 41 has a limit channel 410 and has a first side formed with a protruding latch 411 that can be locked in the locking groove 62. The protruding latch 411 has a bottom face formed with an oblique face 412 corresponding to the guide face 620. The locking member 41 has a second side provided with an elastic member 413 located opposite to the protruding latch 411 and urged on the housing 1. The limit member 42 is mounted on the root section 30 of the shackle 3. When the number wheel unit 40 is disposed at the locked state to lock the shackle 3, the limit member 42 is confined in the limit channel 410 by limit of the root section 30 of the shackle 3, so that the locking member 41 is not movable. When the number wheel unit 40 is disposed at the unlocked state to unlock the shackle 3, the limit member 42 is allowed to be detached from the limit channel 410 by upward push of the retractable shaft 400, so that the locking member 41 is movable freely.

The key lock module 5 includes a lock core 50 secured in the housing 1, and a spindle 51 extended through the lock core 50. The spindle 51 has an end formed with a control portion 52 protruding from the lock core 50 and engaged with the base portion 21 of the catch member 2.

In addition, as shown in FIG. 3, the key lock module 5 is not rotated by a specified key, wherein the indicator 6 is located in the first position, while the protruding latch 411 of the locking member 41 is rested on the bottom of the slide 60 of the indicator 6, so that the indicator 6 cannot be moved downward. At this time, the first mark 220 is exposed outward and the second mark 221 is covered by the indicator 6.

Figure 4A:
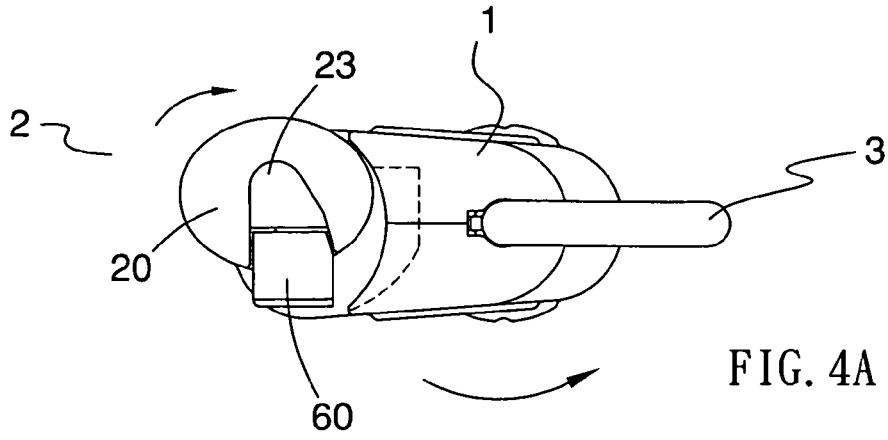
FIG. 4A is a top plan view of the dual-lock type padlock as shown in FIG. 4.
Figure 4:
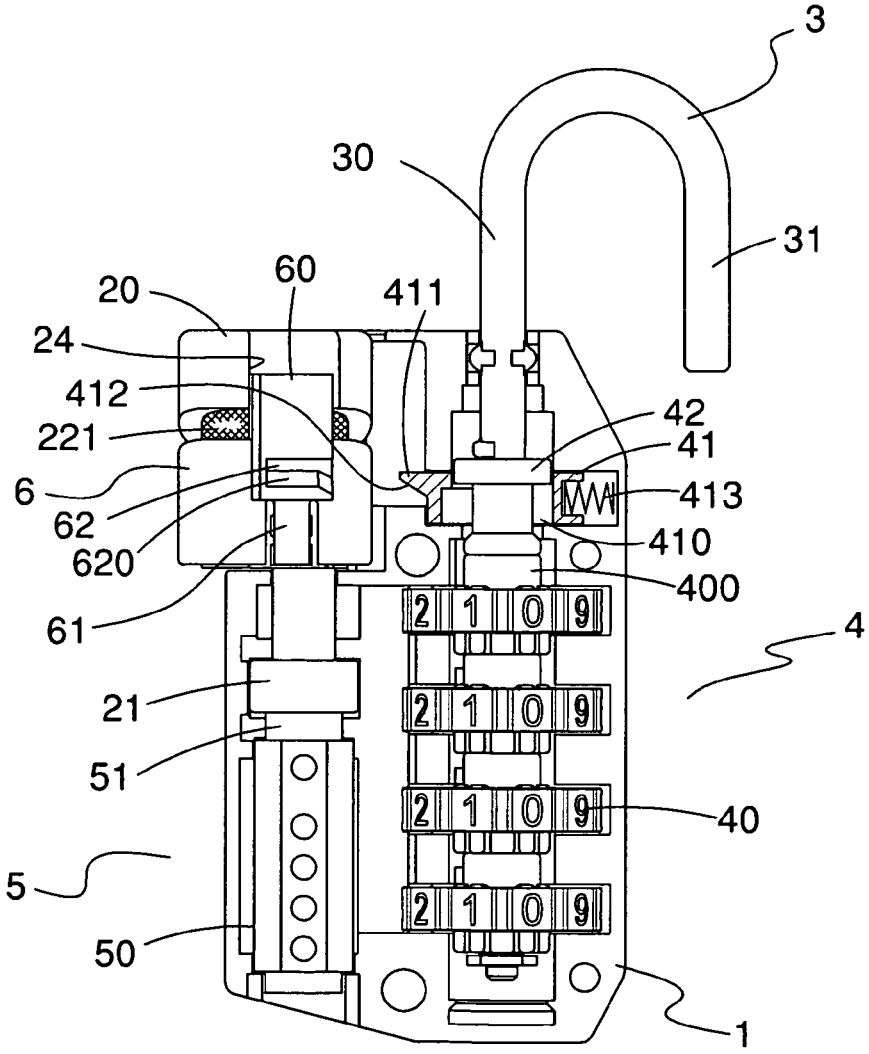
FIG. 4 is a schematic operational view of the dual-lock type padlock as shown in FIG. 3.
Figure 5:
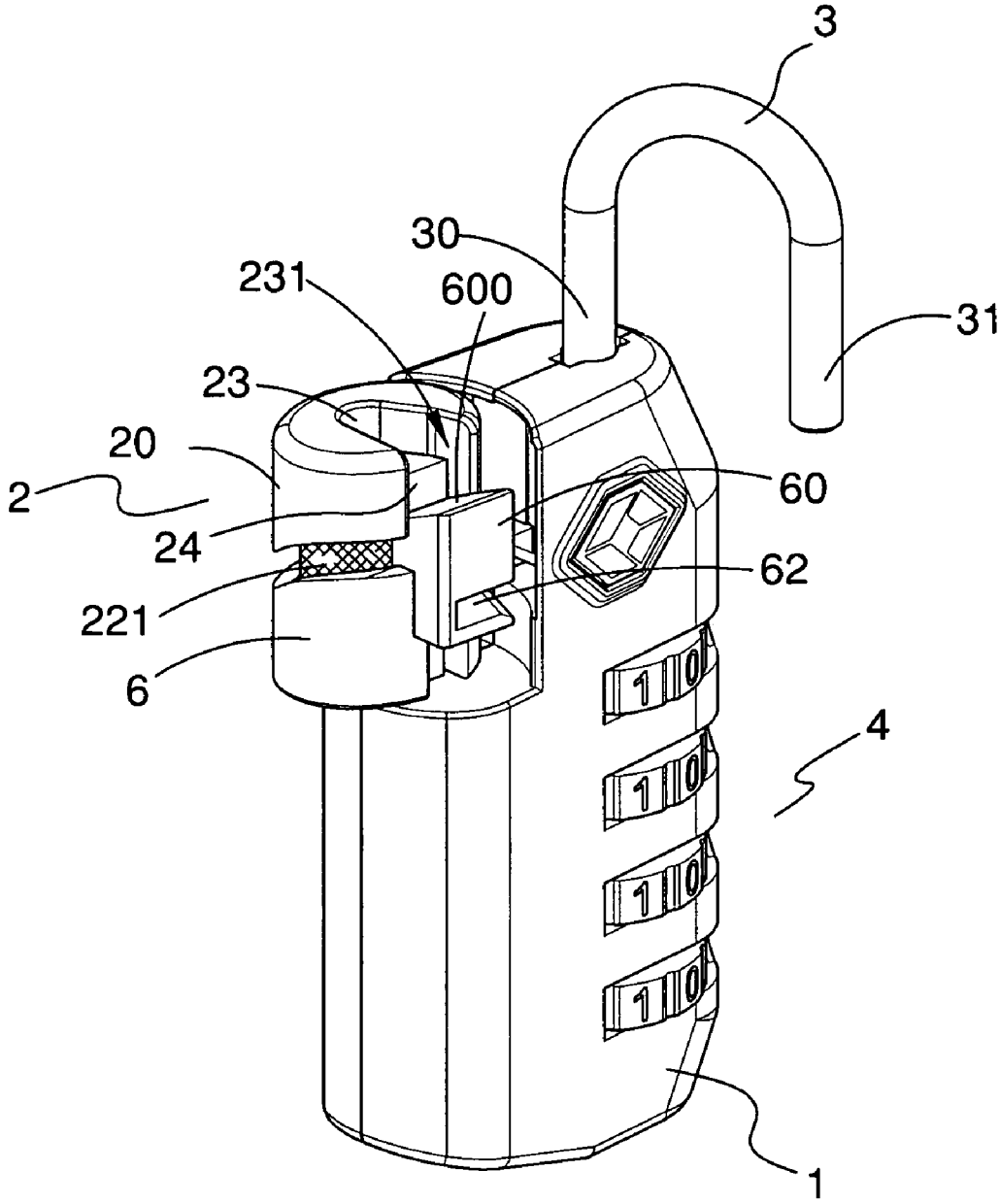
FIG. 5 is a schematic operational view of the dual-lock type padlock as shown in FIG. 1.

Referring to FIGS. 4, 4A and 5, the key lock module 5 is rotated by a specified key to drive the base portion 21 which rotates the limit knob 20 of the catch member 2 to reach an opened position, so that the free section 31 of the shackle 3 is allowed to be rotated in order to enter into or depart from the receiving recess 23. When the limit knob 20 is rotated to reach the opened position, the indicator 6 is rotated with the limit knob 20 to detach the locking groove 62 of the indicator 6 from the protruding latch 411 of the locking member 41. The free section 31 of the shackle 3 can then be rotated to depart from the receiving recess 23. Rotation of the free section 31 of the shackle 3 enables the bottom end of the free section 31 to be moved to push the tapered face 600 of the slide 60 and have the indicator 6 move downward, so that the elastic hook 61 is hooked in the lower positioning groove 240. At this time, the second mark 221 is exposed outward and the first mark 220 is covered by the indicator 6, so that the user can judge if the padlock has been unlocked by a specified key by exposure of the second mark 221.

Figure 6A:
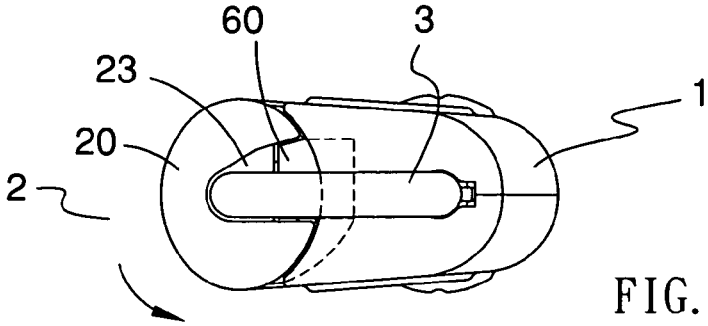
FIG. 6A is a top plan view of the dual-lock type padlock as shown in FIG. 6.
Figure 6:
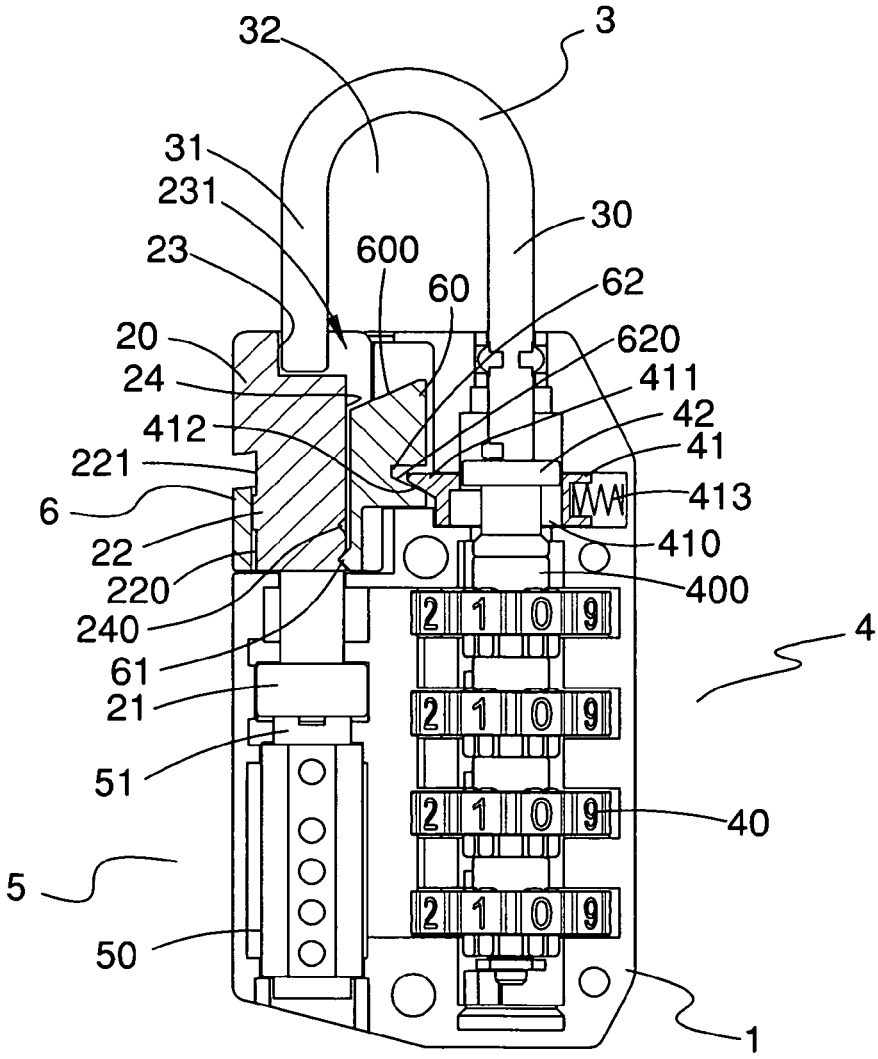
FIG. 6 is a schematic operational view of the dual-lock type padlock as shown in FIG. 4.

Referring to FIG. 6, when the limit knob 20 of the catch member 2 is rotated reversely by the key lock module 5 to move from the opened position to a closed position, the locking groove 62 of the indicator 6 is locked by the protruding latch 411 of the locking member 41.

Figure 7:
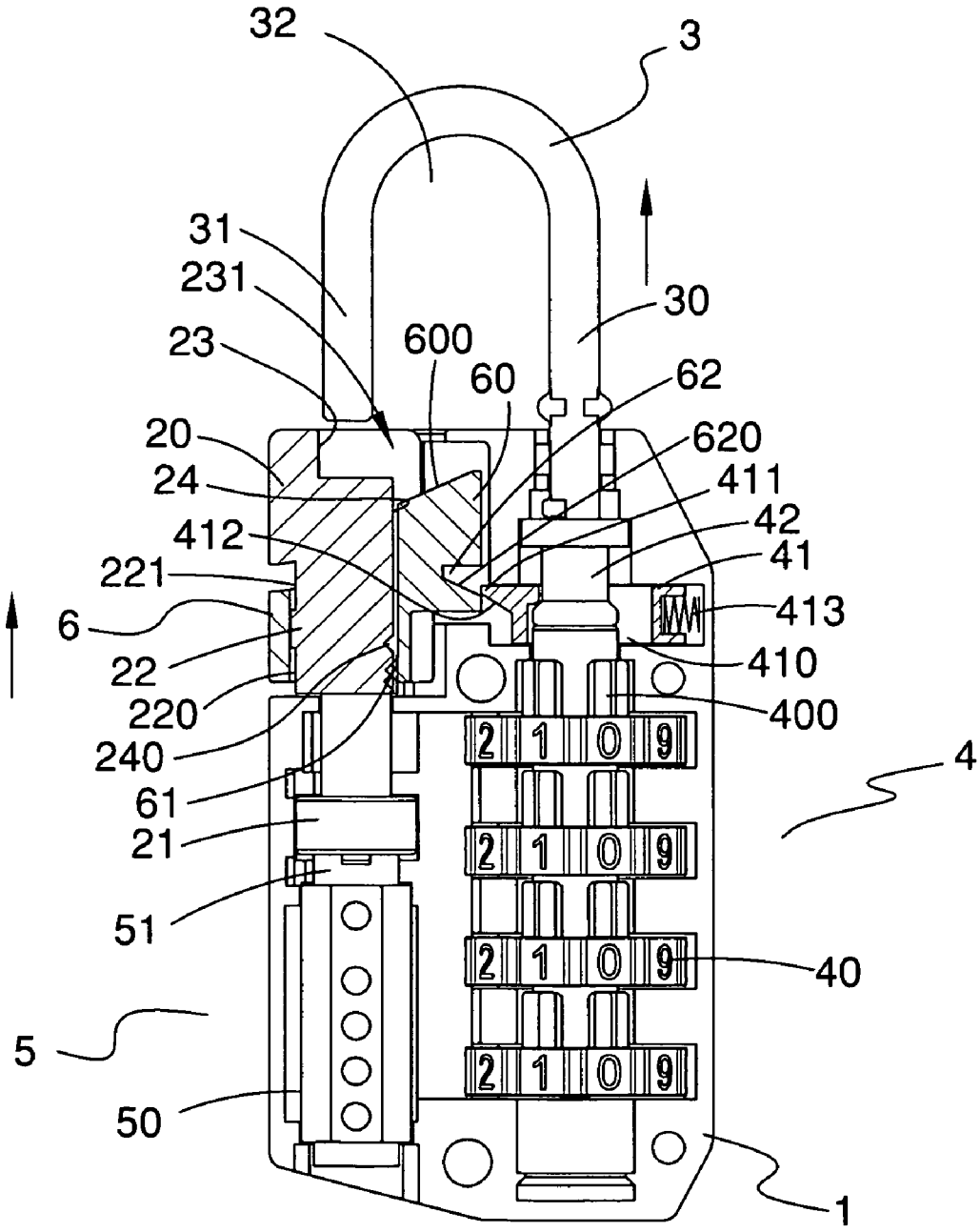
FIG. 7 is a schematic operational view of the dual-lock type padlock as shown in FIG. 6.

Referring to FIG. 7, the number wheel unit 40 is disposed at the unlocked state to unlock the shackle 3 and the shackle 3 is lifted to detach the free section 31 of the shackle 3 from the receiving recess 23, the limit member 42 is moved and pushed by the retractable shaft 400 to be detached from the limit channel 410, so that the locking member 41 is movable freely. Then, when the indicator 6 is pushed upward, the oblique face 412 of the protruding latch 411 slides on the guide face 620 of the locking groove 62, so that the locking member 41 is moved sideward until the indicator 6 is returned to the first position where the first mark 220 is exposed outward.

Figure 8B:
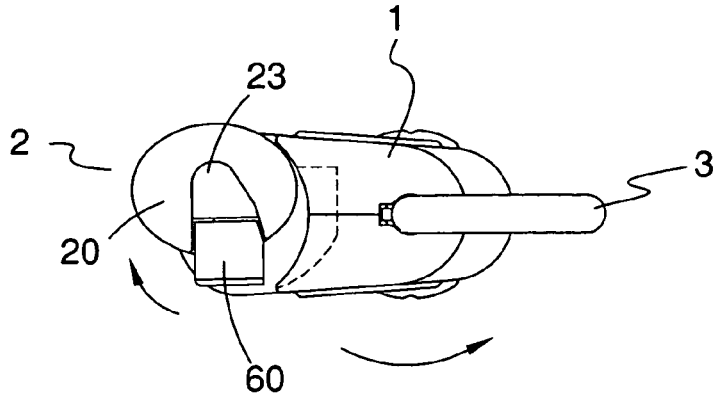
FIG. 8B is a top plan cross-sectional view of the dual-lock type padlock as shown in FIG. 8.
Figure 8A:
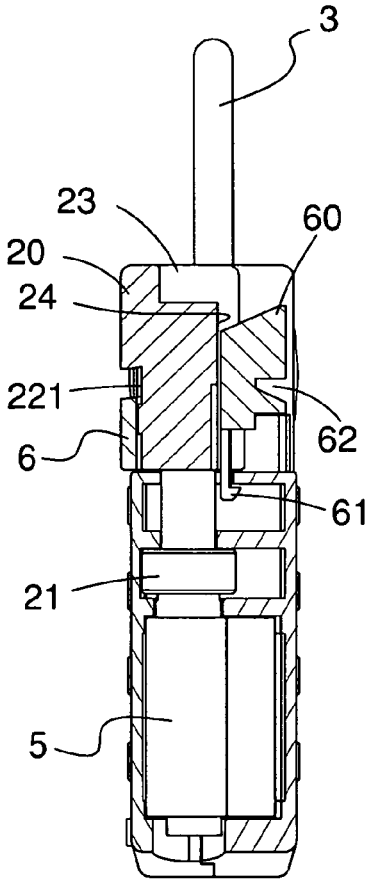
FIG. 8A is a side plan cross-sectional view of the dual-lock type padlock as shown in FIG. 8.
Figure 8:
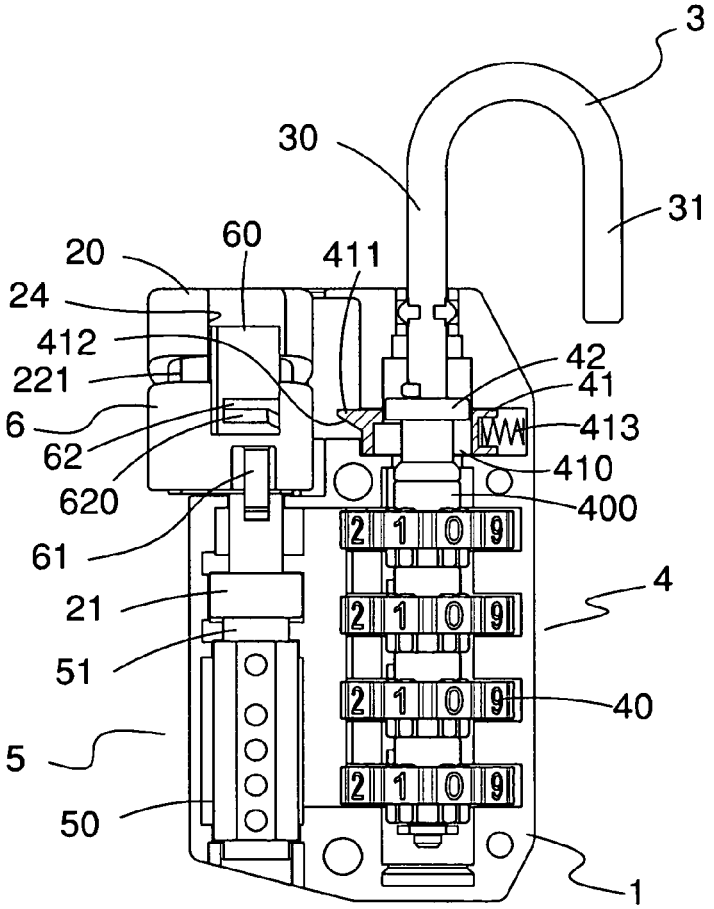
FIG. 8 is a front plan cross-sectional view of a dual-lock type padlock in accordance with the second preferred embodiment of the present invention.
Figure 9A:
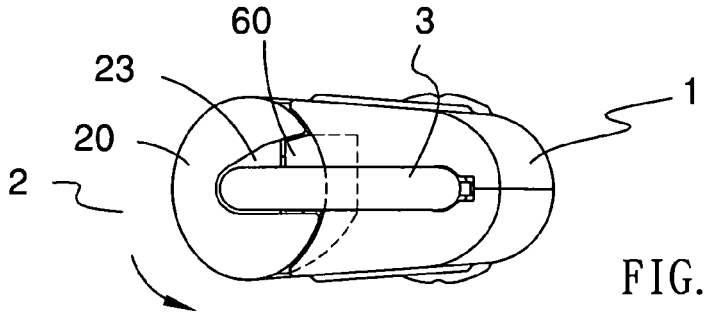
FIG. 9A is a top plan view of the dual-lock type padlock as shown in FIG. 9.
Figure 9:
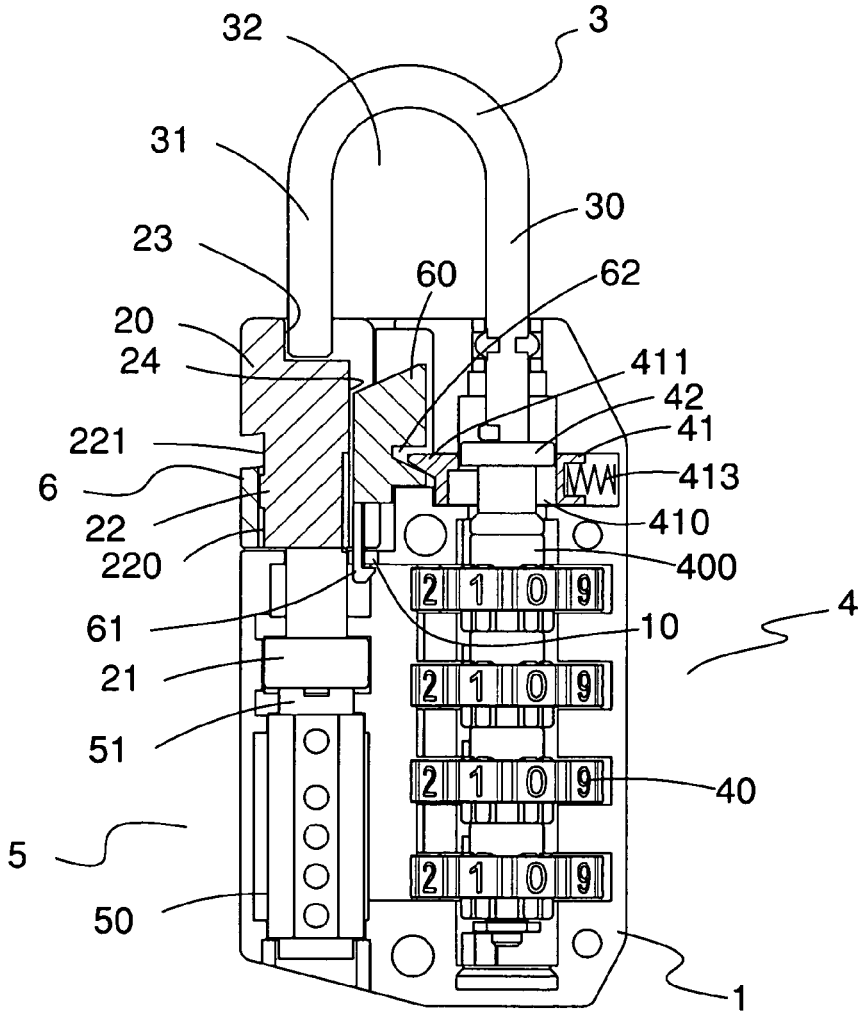
FIG. 9 is a schematic operational view of the dual-lock type padlock as shown in FIG. 8.
Figure 10:
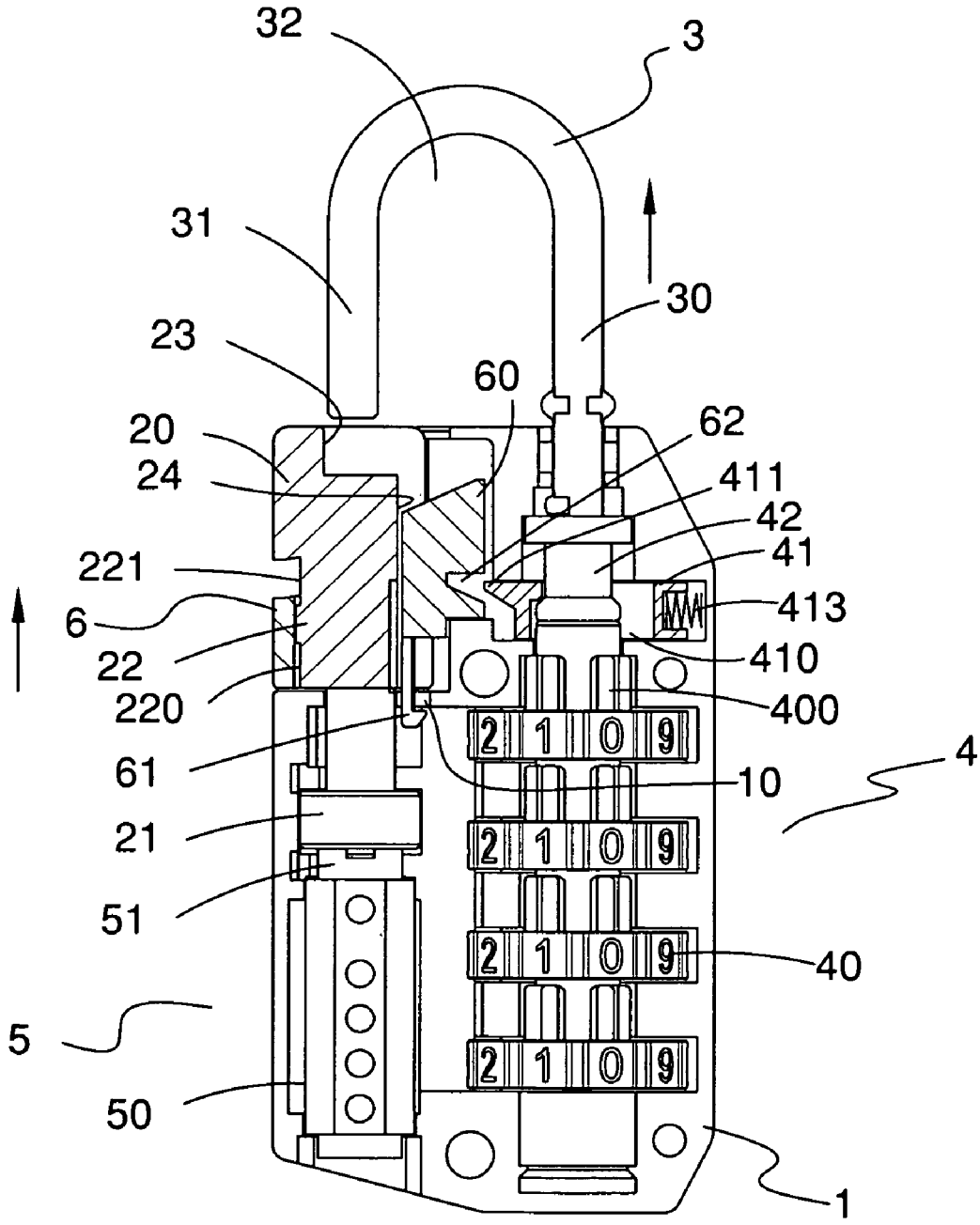
FIG. 10 is a schematic operational view of the dual-lock type padlock as shown in FIG. 9.

Referring to FIGS. 8-10, a dual-lock type padlock having a double reminding function in accordance with the second preferred embodiment of the present invention is similar to that of the first preferred embodiment, wherein the difference is in that the elastic hook 61 is hooked outward, and the housing 1 has a passage 10 corresponding to the elastic hook 61 at the locked state.

As shown in FIGS. 8, 8A and 8B, when the indicator 6 is pushed downward to expose the second mark 221, the elastic hook 61 is hooked on the housing 1.

As shown in FIGS. 9 and 9A, when the limit knob 20 is rotated reversely by the key lock module 5 to move from the opened position to the closed position, the elastic hook 61 is aligned with the passage 10 of the housing 1.

As shown in FIG. 10, when the number wheel unit 40 is disposed at the unlocked state and the indicator 6 is pushed upward, the elastic hook 61 is expanded through the passage 10 of the housing 1.

In conclusion, the catch member 2 is provided with an indicator 6. When the limit knob 20 is rotated to the opened position, the indicator 6 is released. The indicator 6 is not moved when the indicator 6 is not subjected to a force. On the contrary, when the free section 31 of the shackle 3 is removed from the receiving recess 23, the free section 31 of the shackle 3 pushes the indicator 6 from a first position (or original position) to a second position (or indicative position) to expose the second mark 221 outside the housing 1, so that the user can judge if the padlock has been unlocked by a specified key by exposure of the second mark 221.

Figure 11:
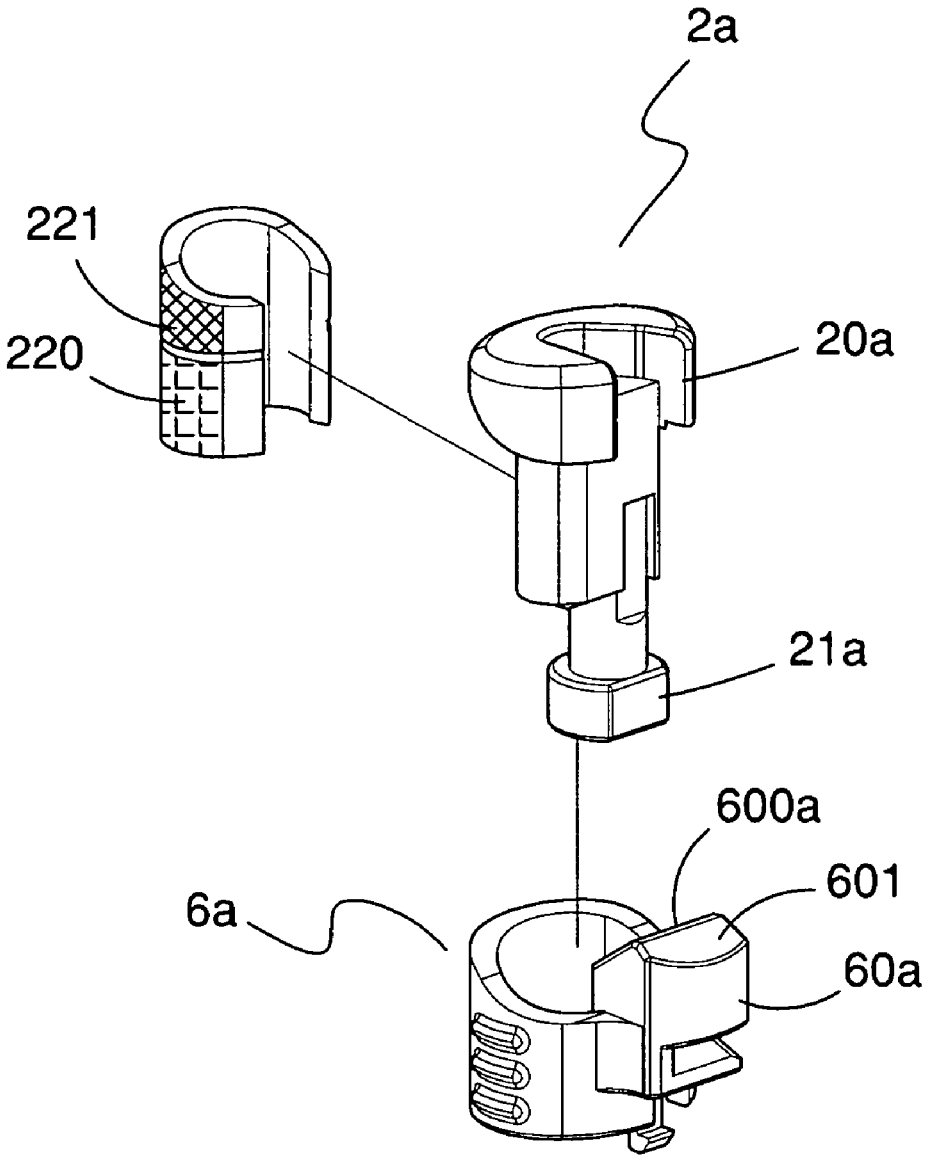
FIG. 11 is an exploded perspective view of a catch member and an indicator of the dual-lock type padlock in accordance with the third preferred embodiment of the present invention.

FIG. 11 shows a catch member 2*a* and an indicator 6*a* of a dual-lock type padlock in accordance with the third preferred embodiment of the present invention, similarly to the catch member 2 and the indicator 6 of the first and second embodiments. As shown in FIG. 11, the catch member 2*a* includes a limit knob 20*a* and a base portion 21*a* extended from the bottom face of the limit knob 20*a*. The indicator 6*a* also has a side formed with a slide 60*a* with a tapered face 600*a*. Additionally, the slide 60*a* further has an inclined face 601 oppositely connected with the tapered face 600*a* of the slider 60*a*. In the third preferred embodiment, the tapered face 600*a* and the inclined face 601 are provided for assisting the indicator 6*a* in position precisely. Preferably, as shown in FIG. 11, a first mark 220 and a second mark 221 of the third embodiment are adhesively attached to the catch. member 2*a* or are clipped to the catch member 2*a*.

Figure 12:
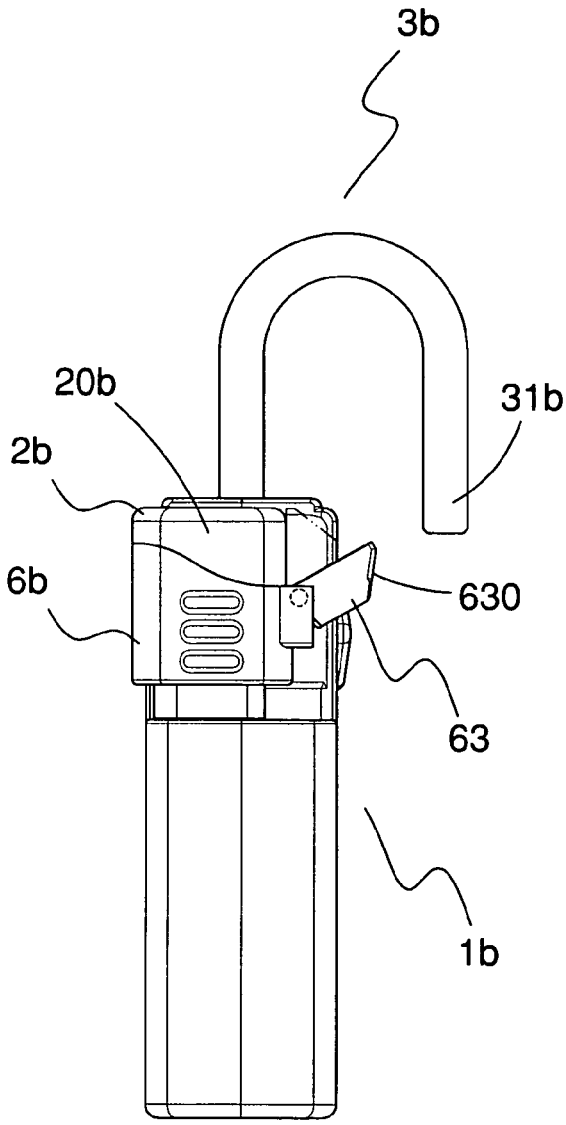
FIG. 12 is a schematic operational view of the dual-lock type padlock in accordance with the fourth preferred embodiment of the present invention.
Figure 13:
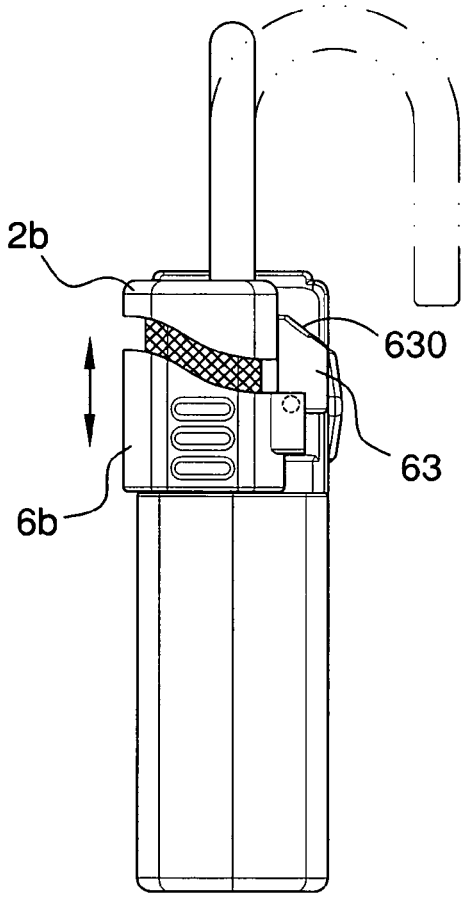
FIG. 13 is a schematic operational view of the dual-lock type padlock as shown in FIG. 12.

FIGS. 12-13 further show a dual-lock type padlock in accordance with the fourth preferred embodiment. Similarly to the foregoing embodiments, the dual-lock type padlock comprises a housing 1*b*, a catch member 2*b*, a shackle 3*b*, a locking mechanism, and an indicator 6*b*. The catch member 2*b* includes a limit knob 20*b*, which has a receiving recess having a first opening located at the top face of the limit knob 20*b* and a second opening located at the side face of the limit knob 20*b*, similarly to the limit knobs of the above embodiments. Additionally, the indicator 6*b* has a block 63 pivoted elastically on the indicator 6*b* and facing to the second opening of the limit knob 20*b*. The block 63 has a top formed with a tapered face 630 inclined away from the second opening of the limit knob 20*b*. Differently to the above preferred embodiments, as shown in FIGS. 12-13, the indicator 6*b* is disposed in the second position only after the tapered face 630 of the block 63 is pushed by a free section 31*b* of the shackle 3*b*. More specifically, the block 63 blocks the second opening of the limit knob 20*b* when the indicator 6*b* is disposed in the first position. After the catch member 2*b* is moved by the locking mechanism, namely the key lock module as described in above embodiments, the free section 31*b* of the shackle 3*b* is capable of rotating away from the limit knob 20*b* by pushing the pivoted block 63, which is elastically returnable to its original position. Subsequently, when the free section 31*b* of the shackle 3*b* is moved back to the limit knob 20*b*, the free section 31*b* of the shackle 3*b* pushes the tapered face 630 of the returned block 63, and the indicator 6*b* is accordingly moved downwardly and disposed in the second position. Furthermore, the indicator 6*b* could be returned from the second position to the first position only when a number lock module of the locking mechanism is at the unlocked state.

Figure 15:
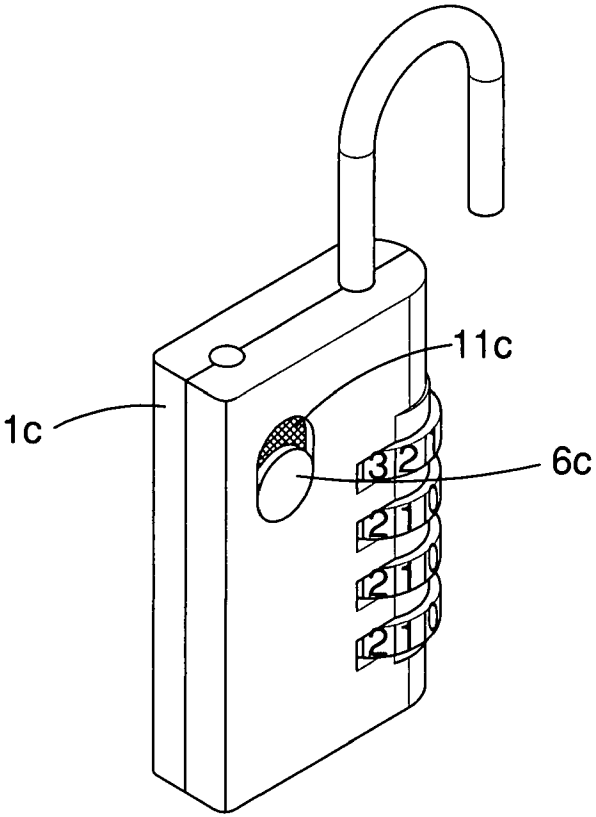
FIG. 15 is a schematic operational view of the dual-lock type padlock as shown in FIG. 14.
Figure 14:
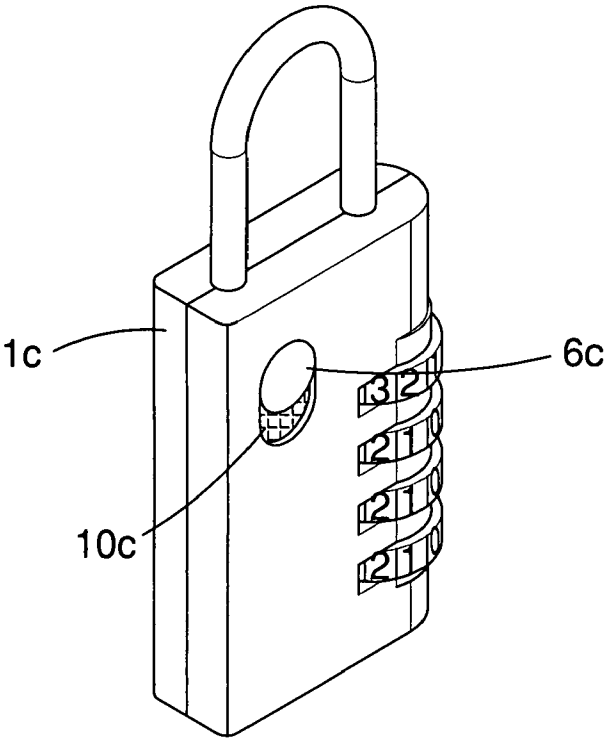
FIG. 14 is a perspective view of a dual-lock type padlock in accordance with the fifth preferred embodiment of the present invention.

Referring to FIGS. 14 and 15, a dual-lock type padlock having a double reminding function in accordance with the fifth preferred embodiment of the present invention is similar to that of the first preferred embodiment, wherein the difference is in that an indicator 6*c* is movably mounted on an outer face of the housing 1*c*. When the padlock is unlocked by a specified key, the indicator 6*c* is changed from a first position to a second position. In addition, the indicator 6*c* is returned from the second position to the first position only when the number lock module is disposed at the unlocked state. The housing 1*c* is formed with a first mark 10*c* and a second mark 11*c*. When the indicator 6*c* is disposed in the first position, the first mark 10*c* is exposed outward and the second mark 11*c* is covered by the indicator 6*c*. When the indicator 6*c* is disposed in the second position, the second mark 11*c* is exposed outward and the first mark 10*c* is covered by the indicator 6*c*. Thus, the user can judge if the padlock has been unlocked by inspecting movement of the indicator 6*c*. In addition, the first mark 10*c* and the second mark 11*c* are selected from either one of the group including character, figures, colors and signals.

Accordingly, the padlock is provided with a limit knob whose movement is controlled by a locking mechanism, so that when the limit knob is moved to an opened position, the shackle is rotated to detach from the limit knob. In addition, the indicator is movably mounted on an outer face of the housing or the catch member which is formed with a first mark and a second mark in the corresponding positions, so that the user can judge if the padlock has been unlocked by inspecting the position of the first mark or the second mark, and can also feel the position of the indicator by touching the indicator so as to judge if the padlock has been unlocked, thereby facilitating the blind people operating the padlock.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A lock comprising:

a housing;

a locking mechanism disposed in the housing and including a first module and a second module both configured to lock or unlock the lock; and an indicator capable of moving from an original position to an indicative position outside the housing in response to operation of the first module, wherein when the indicator is located in the indicative position, locking or unlocking the lock via the first module does not cause the indicator to return back to the original position.

2. The lock of claim 1, wherein the indicator is allowed to be returned from the indicative position to the original position when the lock is unlocked via the second module.

3. The lock of claim 1 further comprising a shackle rotatably connected with the housing and a catch member movably connected with the housing, wherein the catch member moves from a closed position to an opened position when the first module is operated to unlock the lock and returns from the opened position to the closed position when the first module is operated to lock the lock; and the shackle is prevented from rotation when the catch member is located in the closed position and is free to rotate when the catch member is located in the opened position.

4. The lock of claim 3, wherein the indicator is allowed to be returned from the indicative position to the original position when the lock is unlocked via the second module.

5. The lock of claim 3, wherein the catch member is partly located outside the housing and the indicator is mounted on the catch member.

6. The lock of claim 5, wherein the indicator is allowed to be returned from the indicative position to the original position when the lock is unlocked via the second module.

* * * * *